US006582224B1

(12) United States Patent
Lilien et al.

(10) Patent No.: US 6,582,224 B1
(45) Date of Patent: Jun. 24, 2003

(54) ANIMAL TOOTHBRUSH

(76) Inventors: Lawrence D. Lilien, 12121 E. Gold Dust Ave., Scottsdale, AZ (US) 85259; Gregory Lilien, 12121 E. Gold Dust Ave., Scottsdale, AZ (US) 85259

( * ) Notice: Subject to any disclaimer, the term of this patent is extended or adjusted under 35 U.S.C. 154(b) by 0 days.

(21) Appl. No.: 10/095,390

(22) Filed: Mar. 12, 2002

(51) Int. Cl.[7] ..... B08B 1/00; A61D 7/00
(52) U.S. Cl. ..... 433/1; 134/6
(58) Field of Search ..... 134/6; 433/216, 433/1; 15/23, 22.1

(56) References Cited

U.S. PATENT DOCUMENTS

| | | | | |
|---|---|---|---|---|
| 931,143 | A | | 8/1909 | Phillips |
| 1,173,032 | A | | 2/1916 | Reiche |
| 1,243,579 | A | | 10/1917 | Bates |
| 1,554,657 | A | | 4/1925 | Patterson |
| 4,479,516 | A | | 10/1984 | Hunter |
| D294,885 | S | | 3/1988 | Mollenhoff |
| 4,796,323 | A | | 1/1989 | Benz |
| 4,845,796 | A | | 7/1989 | Mosley |
| 4,850,071 | A | * | 7/1989 | Lawrence |
| 5,044,035 | A | | 9/1991 | Barradas |
| 5,613,258 | A | | 3/1997 | Hilfinger et al. |
| 5,699,575 | A | | 12/1997 | Peifer |
| 5,794,296 | A | | 8/1998 | Wong |
| 5,809,601 | A | | 9/1998 | Rivera |
| 5,822,821 | A | | 10/1998 | Sham |
| 5,870,790 | A | | 2/1999 | Root et al. |
| 6,058,542 | A | | 5/2000 | Lo |
| 6,098,635 | A | * | 8/2000 | Marino |
| 6,170,107 | B1 | | 1/2001 | George et al. |
| 6,253,404 | B1 | | 7/2001 | Boland et al. |
| 6,324,713 | B1 | * | 12/2001 | Barkley |

* cited by examiner

*Primary Examiner*—Randall E. Chin
(74) *Attorney, Agent, or Firm*—Lewis J. Hoffman; Edwin A. Swaminen

(57) ABSTRACT

A powered rotational toothbrush for cleaning the teeth of a dog. The toothbrush includes a battery powered handle having a rotational output shaft coupled to a cylindrical brush. The handle includes a button for initiating the rotation of the brush. A method of using the toothbrush includes rotating the brush while the dog bites down onto it.

20 Claims, 2 Drawing Sheets

ANIMAL TOOTHBRUSH

BACKGROUND OF THE INVENTION

The present invention relates to oral hygiene devices for animals, and specifically to a mechanically assisted rotary toothbrush for pets.

Oral hygiene is of primary concern to many pet owners due to the effects of dental disease. Dental disease begins with plaque. Plaque is the film of bacteria that colonizes the tooth surface. Minerals present in saliva can precipitate onto the plaque covered tooth surface, resulting in dental tartar. Throughout this process bacteria can adhere to the tooth surface below the gum line referred to as the subgingival surface. This is the beginning of periodontal disease that causes local infection that may result in tooth loss, bad breath, and pain on chewing. Also bacteria can gain access to the bloodstream and can infect heart, lungs, liver, and kidneys and can substantially shorten a dog's life expectancy.

Due to the shape and arrangement of the posterior teeth and due to the openings of the zygomatic and parotid salivary ducts (just above the upper lateral surface of the posterior teeth), dental plaque and tartar accumulate more predominantly on the posterior teeth, especially the lateral (buccal) surfaces of the upper posterior teeth. Tongue movement, during and after eating, and while panting, helps keep the medial (lingual) surfaces clean.

Regular cleaning of the teeth can reduce the prevalence of the aforementioned health and hygiene problems. Thus, a number of devices have been developed over the years for cleaning the teeth of animals, especially dogs. Most of these known devices are adaptations of traditional toothbrushes designed for human use. However, inducing a dog or other animal to allow its teeth to be adequately cleaned can be a difficult task.

Advancement in this field has led to the development of flavored toothpastes designed to be appealing to the animal. For example, the toothpaste may have the flavor of beef, providing a needed incentive for a dog to allow its teeth to be brushed.

Even with the enticement of an attractive flavor, effectively cleaning a dog's teeth with a brush can be exceedingly impractical. When presented with the flavor-laden brush, the dog will almost always bite or chew on the brush, preventing the dog's owner from scrubbing its teeth.

Even mechanically assisted devices, such as electric toothbrushes, do not solve the above-mentioned problem. Conventional electric toothbrushes for humans generally have a vibrating or reciprocating head. These devices are ineffective on dogs and other animals, because they do not prevent the dog from biting down and restricting the movement of the brush.

BRIEF SUMMARY OF THE INVENTION

The present invention provides a power assisted toothbrush for cleaning the teeth of a domestic animal. The toothbrush comprises: a powered rotational drive assembly comprising a rotational output; a brush shaft coupled to the rotational output, the brush shaft having a longitudinal axis; a plurality of bristles, each of the plurality of bristles being connected to the brush shaft, and each of the plurality of bristles radially extending from the brush shaft; and a biting surface of rotation defined by free ends of the bristles as rotated about the longitudinal axis.

According to another aspect, the present invention provides a method for cleaning the teeth of an animal. The method comprises steps of: inserting a brush into a mouth of an animal; biting on the brush by the animal; and rotating of the brush by a powered rotational drive assembly with sufficient force to maintain the rotating despite the biting by the animal.

DETAILED DESCRIPTION OF THE INVENTION

Figure 1:
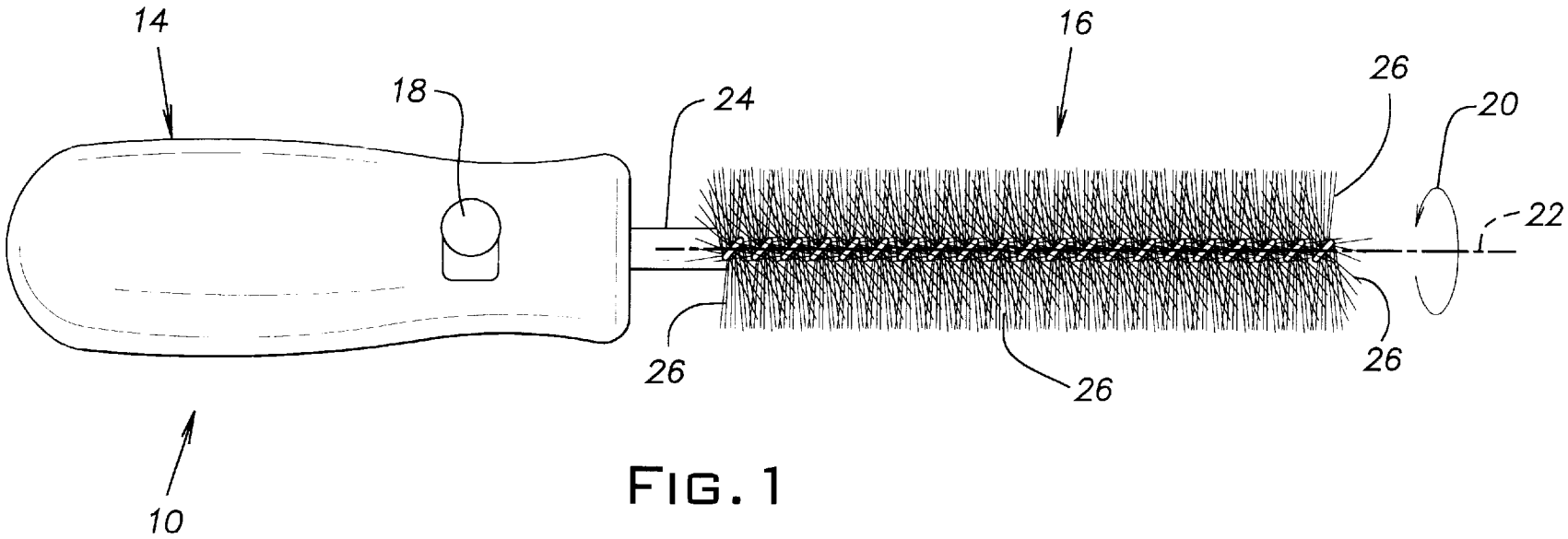
FIG. 1 is a partially schematic view of a powered toothbrush according to one embodiment of the present invention.
Figure 2A:
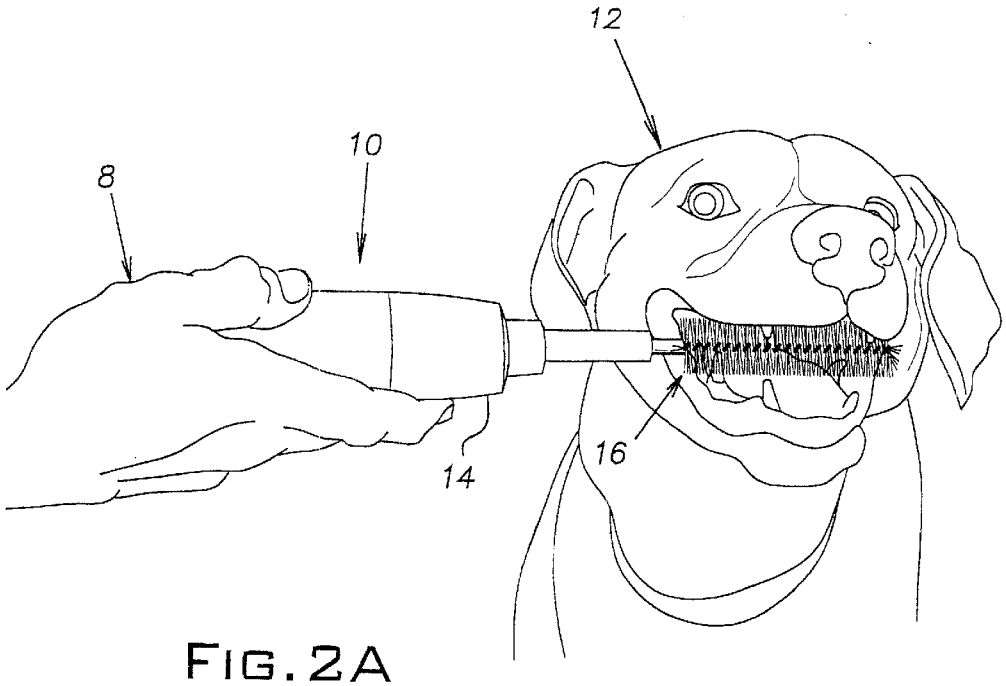
FIG. 2A is a partially schematic view of the powered toothbrush of FIG. 1 shown in use such that a dog is biting across the brush.
Figure 2B:
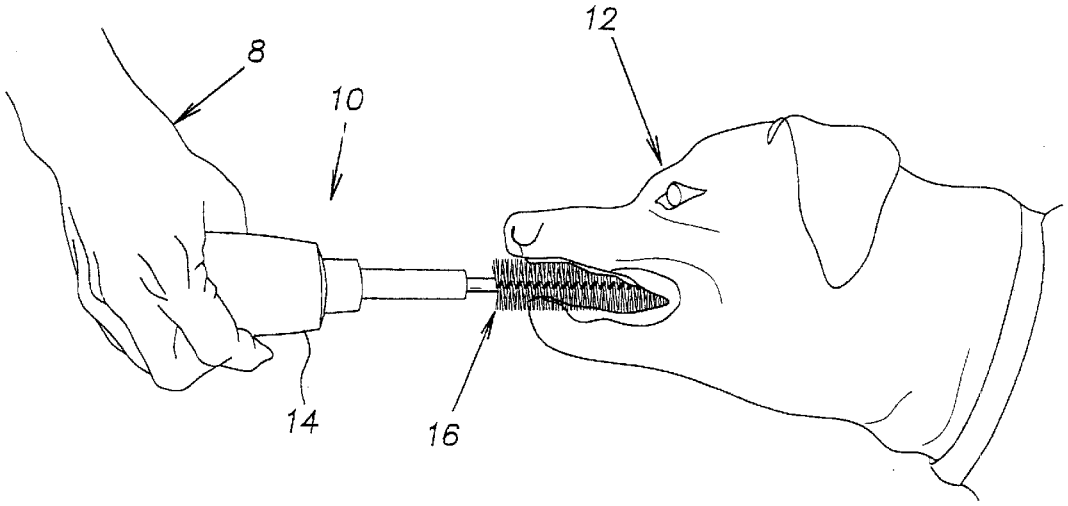
FIG. 2B is a partially schematic view of the powered toothbrush of FIG. 1 shown in use such that the brush is placed in the buccal pouch and directed toward the posterior teeth.

FIGS. 1, 2A, and 2B are partially schematic illustrations of one embodiment of a powered or mechanically assisted toothbrush 10 for cleaning the teeth of a dog 12 according to the present invention. Alternatively, the toothbrush 10 could be used to clean the of other animals.

As best shown in FIG. 1, the toothbrush 10 comprises a powered rotational drive assembly or handle 14 and a brush 16 extending therefrom. The drive assembly 14 is of a conventional type known in the art of hand-held power tools, having a rotational drive means and a power source. The drive assembly 14 functions to provide powered rotation of the brush 16. As best shown in FIGS. 2A and 2B, the drive assembly 14 also provides a handle or gripping surface, allowing the toothbrush 10 to be held and operated with a hand 8 of the user.

Specifically, the rotational drive means of the drive assembly 14 comprises an electric motor. The electric motor is powered by a disposable dry-cell battery located within the drive assembly 14. Alternatively, a rechargeable battery could be substituted, or another source of electric power could be used, such as an external power supply. As a further alternative, other known rotational drive means, including appropriate power sources, can be used within the scope of the present invention. Examples of alternative drive means include pneumatic motors, hydraulic motors, and the like.

An example of a commercially available drive assembly is a power screwdriver, such as the SKIL TWIST model #2106 2.4 Volt Cordless Screwdriver available from S-B Power Tools Company, Chicago, Ill. The cordless screwdriver is referred to herein merely as an example, without regard to specific power output and other requirements necessary for the practice of the present invention. Given the disclosure set forth herein, one of ordinary skill in the pertinent art will appreciate the specific requirements of the present invention in selecting an appropriate drive assembly.

Referring to FIG. 1, the brush 16 is coupled or connected to the drive assembly 14 as a rotationally driven member. A drive actuator or button 18 controls the drive assembly 14, causing it to start rotating and to stop rotating. The button 18 of the present embodiment is a simple momentary pushbutton switch. Alternatively, other types of switching devices can be used.

The brush 16 comprises a central brush shaft 24, through which the brush 16 is coupled to the rotational drive means 14. The brush 16 further includes a plurality of bristles 26, each being connected to the brush shaft 24 and radially extending away from the longitudinal axis of rotation 22.

As described, when the button 18 is depressed, the drive assembly 14 causes the brush 16 to rotate about the longitudinal axis. During this rotation, the tips or free ends of the bristles 26 define a surface of rotation. In the present embodiment, the drive assembly 14 causes the brush 16 to rotate in a single direction 20 about a longitudinal axis 22. Alternatively, the drive assembly 14 may be reversible, such that it rotates in either direction about the longitudinal axis 22.

In the embodiment of FIG. 1, all of the bristles 26 of the brush 16 are approximately the same length, such that the surface of rotation is substantially cylindrical. The length of the bristles 26 is selected to suit the particular animal on which the brush 16 is to be used. Specifically, the bristles 26 should be long enough to reach the subgingival portion of each of the animal's teeth. For most breeds of dogs, for example, a brush having a substantially cylindrical surface of rotation with a diameter of between 15 and 25 millimeters will be adequate.

The brush 16 should be long enough to reach the most posterior teeth of the particular animal on which it is to be used. For example, a brush having a length of between 2 and 4 inches, as measured along the longitudinal axis 22, will be adequate for most dogs (FIG. 2B).

In the present embodiment, the bristles have an individual thickness or diameter of approximately 10 thousandths of an inch. However, other thicknesses may be used. Also, the stiffness of the brush 16 may be varied by changing the thickness or constituent material of the bristles. As a further alternative, other arrangements of bristles and the various shapes of their resulting surfaces of rotation can be used in the present invention.

At least a portion of the brush shaft 24 comprises a pair of wires twisted together to form a double helix shape. The bristles 26 are captured between the two wires of the shaft 24 holding them in place. A single bristle filament forms two bristles 26 extending from opposing sides of the shaft 24. Alternatively, each bristle 26 could be formed from a separate filament.

The shaft may also be made from a plastic material, such as polyvinyl chloride (PVC), by a suitable process, such as injection molding. Other materials and manufacturing methods can alternatively be used. Further, the bristles can be formed integrally, as a one-piece design, or alternatively secured to the shaft as separate members using glue or other known means.

Further according to the present invention, a method for cleaning the teeth of an animal is provided, as best shown with reference to FIGS. 2A and 2B. The method according to an embodiment of the present invention comprises the following steps.

A commercially available flavored toothpaste is placed on the brush 16 to induce the animal 12 to cooperate with the cleaning operation. Such commercially available toothpastes which are intended to be used with dogs are flavored to taste like meat, or alternatively another flavor which is attractive to dogs, and includes a cleaning agent, such as an enzyme.

The brush 16 is then inserted into the mouth of the dog 12 or other animal by the user. Subsequently, the dog 12 commences biting or chewing on the brush 16.

After inserting the brush 16, the user presses the button 18 to commence the powered rotation of the brush 16 by the drive assembly 14. Alternatively, the rotation of the brush 16 may be started before the step of inserting.

The surface of rotation acts as a biting surface, whereas the subject dog 12 bites down onto or through the brush surface while the brush 16 rotates. As shown in FIG. 2A, the brush is placed such that the dog 12 is biting across the brush 16. The brush 16 is moved back to front and front to back thus cleaning exposed tooth surfaces as well as subgingival surfaces. The free ends of the bristles 26 brush along the surface of the dog's teeth and gingival margin during the rotation, having a scrubbing effect. Further, as shown in FIG. 2B, when the rotating brush is placed in the buccal pouch of the dog 12 and directed toward the posterior teeth, this will result in scrubbing of the lateral or buccal surfaces of the posterior teeth of the dog 12. The buccal surfaces of the posterior teeth are especially prone to develop tartar.

A bite-resisting means is provided to the toothbrush 10 of the present invention, such that the brush 16 is capable of rotating against the biting force of the dog 12. Thus, it will be appreciated by one of ordinary skill in the related art, that the drive assembly 14 must be designed or selected to provide sufficient velocity and rotational force or torque to the brush 16 to initiate and maintain the rotating despite the biting by the dog 12. For example, the embodiment provides approximately 30–40 inch-pounds (in-lbs) of torque, rotating at approximately 130–150 revolutions per minute (rpm's). While different torques and speeds may be appropriate depending upon the particular animal upon which the toothbrush 10 is used, according the present invention, a minimum of 25 in-lbs and 120 rpm's, respectively, are required to provide suitable operation for most animals with which the toothbrush 10 is intended to be used.

As best shown in FIG. 2A, when the dog 12 attempts to stop the brush 16 from rotating by biting down, the dog's teeth apply a biting force against the bristles 26 and/or shaft 24 of the brush 16. As long as the brush 16 continues to rotate, due to the bite resisting means described above, a frictional force proportional to the biting force is created between the surface of the dog's teeth and the bristles 26. Thus, by biting and fighting the rotation of the brush 16, the dog 12 helps the bristles 16 clean its teeth.

It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited.

What is claimed is:

1. A method for cleaning the teeth of an animal, comprising steps of:

inserting a brush into a mouth of an animal;

biting on the brush by the animal; and rotating of the brush by a powered rotational drive assembly with sufficient force to maintain the rotating despite the biting by the animal.

2. The method of claim 1, wherein the step of rotating commences before the step of inserting.

3. The method of claim 1, further comprising a step of applying a flavoring agent to the brush.

4. The method of claim 1, wherein the brush comprises at least one bristle extending a determined length from a supporting member, and wherein a length of the at least one bristle is sufficient to make contact with a subgingival tooth surface of the animal during the step of biting.

5. The method of claim 1, wherein the step of rotating commences after the step of inserting.

6. A method for leaning the teeth of an animal comprising:

(a) inserting a brush into the mouth of an animal; and (b) power-rotating the brush within the mouth of the animal with sufficient force to maintain the rotating despite any biting on the brush by the animal.

7. The method of claim 6 wherein the act in part (a) occurs before the act in part (b).

8. The method of claim 6 wherein the act in part (b) begins before the act in part (a).

9. The method of claim 6 further comprising first applying a flavoring agent to the brush.

10. The method of claim 6 wherein inserting a brush comprises inserting an elongated brush shaft coupled axially to a rotational drive assembly and having a multitude of bristles coupled to the brush shaft and radially extending therefrom.

11. The method of claim 10 wherein inserting a brush further comprises inserting a brush shaft having the multitude of bristles that are long enough to make contact with the subgingival tooth surface of the animal in the state where the animal is biting on the brush during rotation of the brush within the mouth of the animal.

12. The method of claim 11 wherein inserting a brush further comprises inserting a brush shaft having pairs of the bristles extending in opposite directions from the brush shaft, wherein the free ends of the bristles define a cylinder with a diameter of between 15 and 25 millimeters.

13. The method of claim 12 wherein inserting the brush shaft comprises inserting the brush shaft having between two and four inches of length.

14. The method of claim 6 wherein power-rotating comprises driving the brush at a rotational speed of at least 120 revolutions per minute.

15. The method of claim 6 wherein power-rotating comprises driving the brush with a torque of at least 25 inch-pounds.

16. The method of claim 6 wherein inserting the brush into the mouth of an animal comprises inserting the brush into the mouth of a domestic animal.

17. The method of claim 16 wherein inserting the brush into the mouth of an animal comprises inserting the brush into the mouth of a dog.

18. The method of claim 6 further comprising reversing the direction of rotation of the brush within the mouth of the animal.

19. A method for cleaning the teeth of an animal comprising:

(a) providing a brush assembly comprising:

(1) a motor having a rotating output shaft, (2) an elongated brush shaft coupled axially to the output shaft, and (3) a multitude of bristles radially extending from the brush shaft;

(b) applying a flavoring agent to the bristles of the brush assembly;

(c) inserting into the mouth of a domestic animal the brush shaft and bristles of the brush assembly with the flavoring agent applied; and (d) causing the motor to rotate the brush shaft and the bristles within the mouth of the animal with sufficient force to maintain the rotating despite any biting by the animal on the brush bristles and brush shaft.

20. The method of claim 19 wherein (a) providing the brush assembly comprises providing a brush assembly further having pairs of the bristles extending in opposite directions from the brush shaft, the free ends of the bristles defining a cylinder with a diameter of between 15 and 25 millimeters, and the brush shaft being between two and four inches long, (b) inserting comprise inserting the brush shaft and bristles in the mouth of a dog, and (c) causing the motor to rotate the brush shaft comprises driving the brush with a torque of at least 25 inch-pounds.

* * * * *

UNITED STATES PATENT AND TRADEMARK OFFICE

CERTIFICATE OF CORRECTION

PATENT NO. : 6,582,224 B1 
DATED : June 24, 2003
INVENTOR(S) : Lawrence D. Lilien and Gregory Lilien It is certified that error appears in the above-identified patent and that said Letters Patent is hereby corrected as shown below:

Title page,
Item [74], *Attorney, Agent, or Firm*, please change "Lewis" to -- Louis --, and change "Swaminen" to -- Suominen --.

Column 5,
Line 1, change "leaning" to -- cleaning --.

Column 6,
Line 33, change "comprise" to -- comprises --.

Signed and Sealed this

Twenty-fifth Day of November, 2003

JAMES E. ROGAN
*Director of the United States Patent and Trademark Office*